United States Patent [19]

Todd

[11] 4,284,232

[45] Aug. 18, 1981

[54] LIQUID-LIQUID CENTRIFUGAL CONTACTING MACHINES AND METHODS OF CONSTRUCTING AND OPERATING THEM

[75] Inventor: David B. Todd, Saginaw, Mich.

[73] Assignee: Baker Perkins Inc., Saginaw, Mich.

[21] Appl. No.: 57,420

[22] Filed: Jul. 13, 1979

[51] Int. Cl.[3] ..... B04B 15/02

[52] U.S. Cl. ..... 233/15

[58] Field of Search ..... 233/2, 15

[56] References Cited

U.S. PATENT DOCUMENTS

| | | | |
|---|---|---|---|
| 3,179,333 | 4/1965 | Claridge | 233/15 |
| 3,221,986 | 12/1965 | Burdett et al. | 233/15 |
| 3,327,939 | 6/1967 | Doyle et al. | 233/15 |

*Primary Examiner*—Stanley N. Gilreath

*Attorney, Agent, or Firm*—Learman & McCulloch

[57] ABSTRACT

A rotor has a coaxial hollow casing with a plurality of concentric radially spaced sieves or screens therein. At least one light phase liquid inlet tube has communication with the radially outer portion of the rotor chamber, and at least one heavy phase liquid inlet tube has communication with the radially inner portion of the rotor chamber to supply light and heavy phase fluids, respectively to the chamber casing. The heavy phase liquid moves radially outward and is removed from the outermost portion of the rotor chamber while the light phase liquid moves radially inwardly and is removed from the radially inner portion of the rotor chamber. The machine is constructed with concentric, radially open distributor or dispersing trays within the rotor chamber communicating directly with each of the light and heavy phase liquid inlet tubes. Each tray includes an annular base wall with radially projecting walls projecting in the form of open ended risers which have large diameter passages extending through them, and which are surrounded by considerably smaller diameter passages in the base wall. The riser walls are of at least such radial extent as to collect a sufficient head of the phase being distributed to pass the phase to be dispersed through the smaller base wall openings under pressure of the tray "head" developed, without countercurrent flow of the other phase through them. The riser openings provide flow of the continuous other phase (not being distributed) counter-directionally through the risers under the driving force of the head, and are sufficiently large to somewhat minimize appropriately the flow force at the riser openings and control the counter-directional flow.

16 Claims, 9 Drawing Figures

LIQUID-LIQUID CENTRIFUGAL CONTACTING MACHINES AND METHODS OF CONSTRUCTING AND OPERATING THEM

BACKGROUND OF THE INVENTION

The centrifugal machine is generally of the type disclosed in prior U.S. Pat. Nos. 2,878,993; 3,050,238; 3,179,333; 3,231,183; 3,231,185; 3,233,880; 3,494,543; 3,770,190; 3,809,375; 3,814,307; and 3,904,109. In practice, present machines manufactured by applicant's assignee utilize ducts which are secured to one of the seives and have sidewall openings which distribute material supplied to the ducts by the feed tubes for the phases. This method of distributing the light and heavy phase liquids is not as satisfactory for larger size contactors, and particularly contactors of increased axial width. Some of the difficulties encountered with the present method are the difficulty of sealing the ducts to the feed tubes and sealing the ends of the ducts. The use of a multiplicity of feed tubes also introduces difficulties in such systems.

SUMMARY OF THE INVENTION

Briefly described the present invention, which is particularly utilizable with machines having an increased axial width and is expected to avoid many of the present problems, utilizes a peripherally or radially open feed tray having large open-ended risers to permit flow of the continuous phase and permit development of a head which drives the phase being dispersed through the smaller distribution holes in the base wall of the tray at a linear velocity which is sufficiently high to preclude counterflow of the other phase. The differential head also provides the driving force for the counterflow of the phase not being dispersed through the risers in the opposite direction. The system to be described, considers the diameter and number of the base openings and the diameter and radial extent of the riser openings such as to provide a uniform flow of phases and a uniform distribution of the phase to be dispersed over the axial length of the tray, which is made of the same axial length as the chamber in which contacting occurs.

Figure 1:
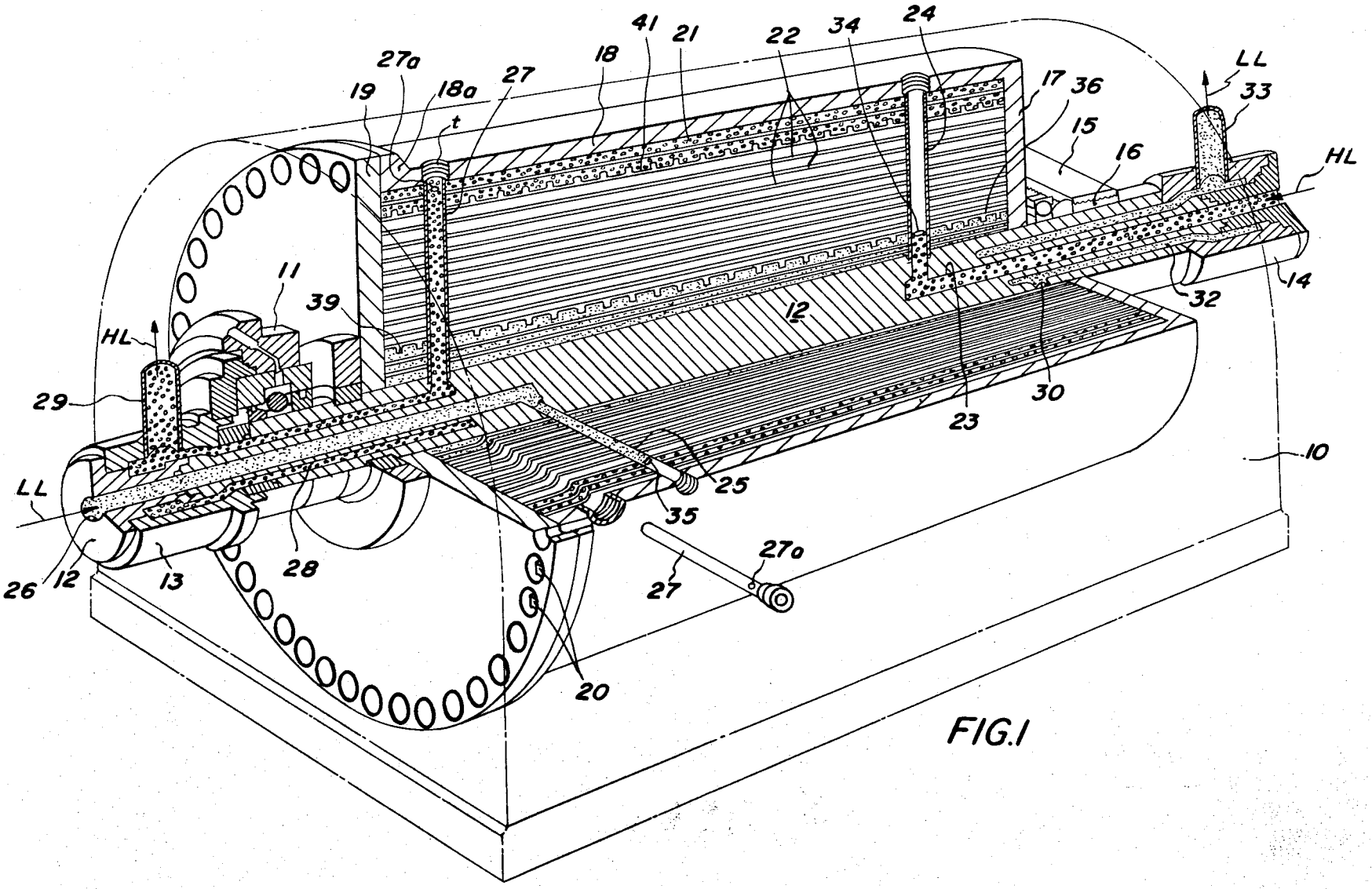
FIG. 1 is a perspective elevational view of a somewhat schematic nature illustrating a contacting machine with a section thereof broken away to illustrate the manner in which light and heavy liquids are supplied to, and removed from, the apparatus.
Figure 2:
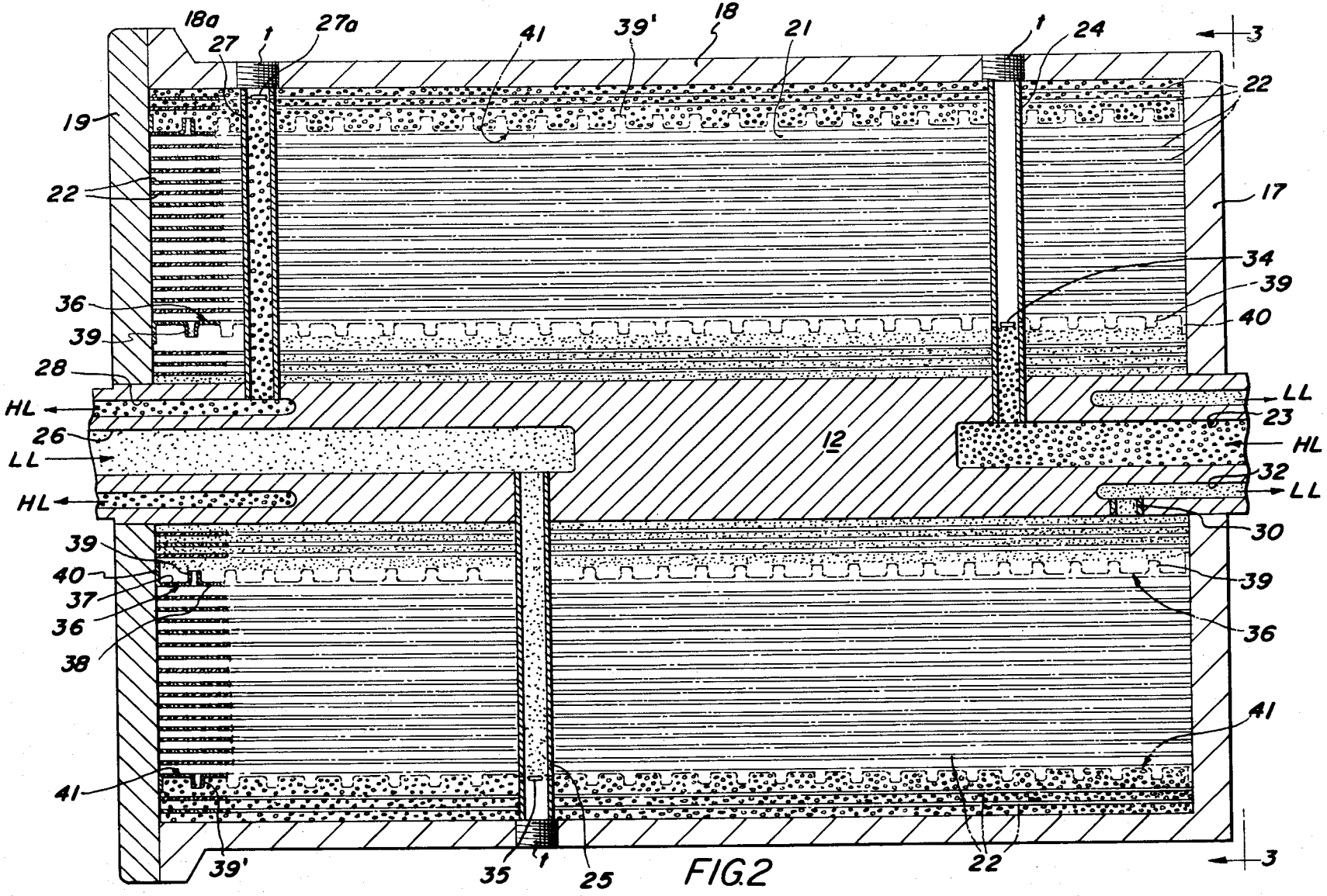
FIG. 2 is a fragmentary, sectional elevational view more particularly illustrating the distributor trays in position in the machine.
Figure 3:
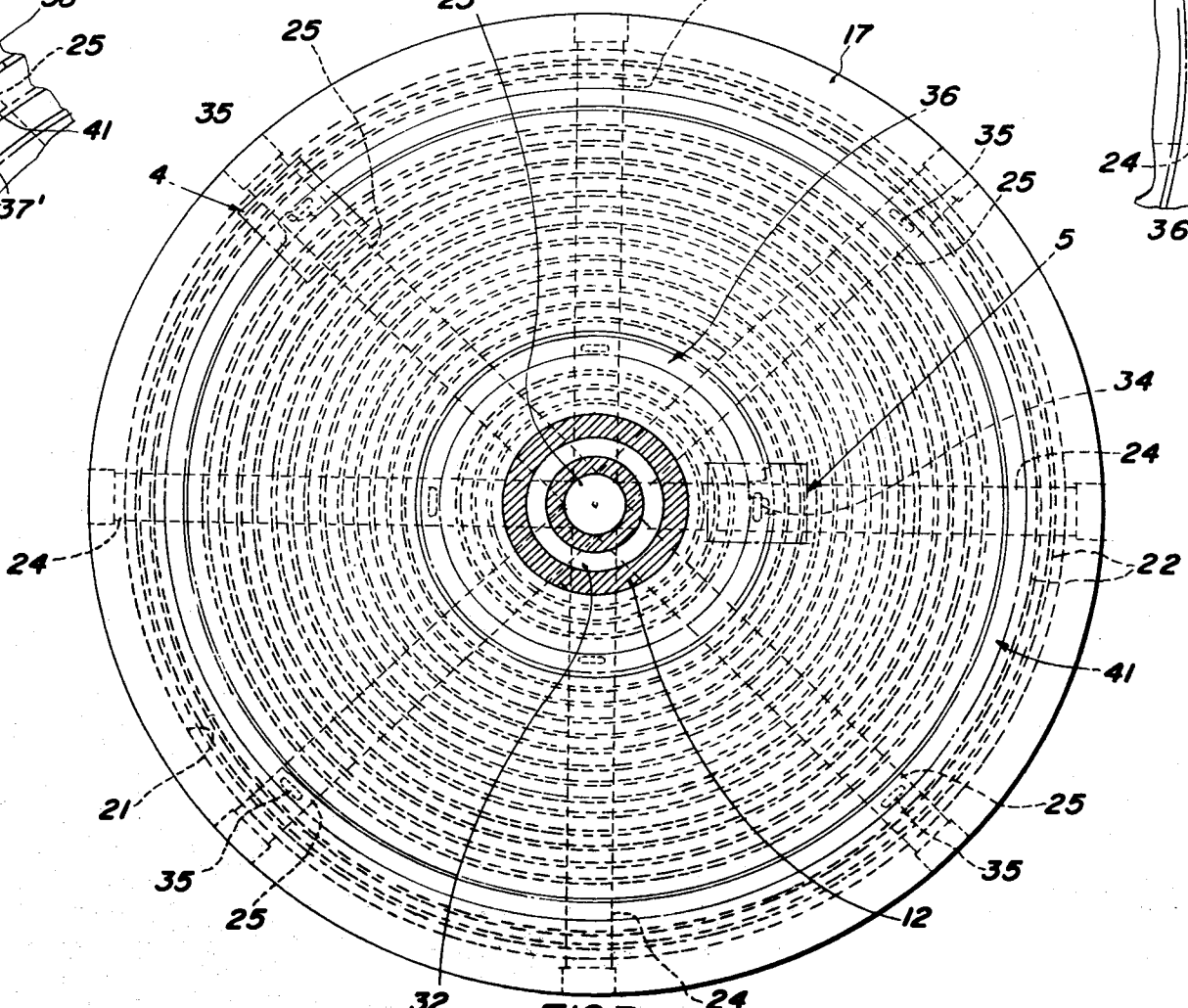
FIG. 3 is a transverse sectional view with chain lines schematically demonstrating the positions of the distributor trays.

Referring now more particularly to the accompanying drawings, and, in the first instance particularly to FIGS. 1, 2, and 3, the contactor includes a base 10 mounting one or more bearing assemblies 11 which journal a rotatable shaft generally designated 12. Mechanical seals generally designated 13 and 14 are provided at opposite ends of the shaft 12, which may be driven by a suitable electric motor via a belt 15 and a sheave 16. An end wall 17, a peripheral wall 18, and a detachable end wall 19 bolted (as at 20) to the flange **18*a* formed on wall 18, define a revolving contacting chamber generally designated 21**.

Provided in concentric relation within the chamber 18, concentric with shaft 12, are a series of radially spaced concentric sieves or perforated partitions 22 which define multiple radially adjacent liquid phase contacting zones. Generally such contactors process immiscible liquid phases of different density. The light liquid (e.g. oil) is designated LL and the heavy liquid (e.g. water) is designated HL. As is well known, in this type of machine, the heavy liquid HL, which is provided to the radially inner portion of the chamber 21, is centrifuged outward. The light liquid LL, which is supplied to the radially outer portion of chamber 21, is thereby displaced inwardly, Tubes, are utilized for separately supplying the light and heavy liquid to, and removing the heavy liquid from, the chamber 21 via the shaft 12.

Provided to feed the heavy liquid HL into the radially inner portion of chamber 21 via coaxial bore 23 in shaft 12, are feed tubes 24. Feed tubes 25 feed light liquid LL to the radially outer portion of rotor chamber 21 via an axially concentric passage 26 provided in the opposite end of shaft 12. While in FIG. 1 the tubes 24 and 25 are schematically depicted as in angular alignment, they actually are disposed out of angular alignment in the spokelike arrangement demonstrated in FIG. 2.

Provided to remove heavy liquid HL from the radially outer portion of chamber 21, after it has processed outwardly from the inner portion of chamber 21, are exit tubes 27 which communicate with a concentric outer passage 28 in shaft 12 and an exit tube 29 connecting through seal 13. The light liquid LL is removed from the radially inner portion of the chamber 21, after it has moved radially through the chamber 21 from the outer portion thereof, via exits 30 and a concentric passage 32 provided in the opposite end of shaft 12 and communicating with an exit tube 33 connecting through the mechanical seal assembly 14. The exit tubes 29 may be angularly arranged in spokelike formation.

As FIG. 3 particularly indicates, slotted openings 34 are provided in tubes 24 near the inner ends thereof to limit the heavy liquid HL to be fed to the radially inner portion chamber 21, and openings 35 are provided in the outer ends of tubes 25 to permit the light liquid LL to proceed through the feed tubes 25 to the radially outer portion of rotor chamber 21.

As FIG. 2 indicates, the discharge tubes 27 for the heavy liquid have openings **27*a*** to permit entrance of the heavy liquid HL thereto. The passageways in wall 18 for all of the tubes 24, 27, and 25 are threaded at their outer ends as at t to permit the threaded, closed outer ends of these tubes to be threaded therein. The structure described thus far is conventional in countercurrent contacting and extraction apparatus and, in FIG. 1, it will be noted that the drawing is shaded to represent clarification zones for each liquid where the perforation pattern in the sieves 22 changes to aid removal of the last traces of entrainment while, for purposes of illustrations, only one screen 22 is shown outboard of tray 41, and only two screens 22 are shown inboard of tray 36, it is to be understood a greater number are contemplated in each instance. Typically dispersing ducts of the general character utilized in U.S. Pat. No. 3,231,183, and having side wall openings, are employed in commercial machines.

Figure 5:
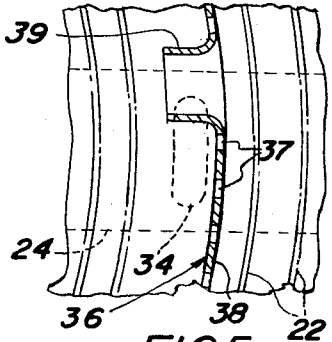
FIG. 5 is a similar, greatly enlarged view of the area indicated to be in section 5 in FIG. 3.
Figure 7:
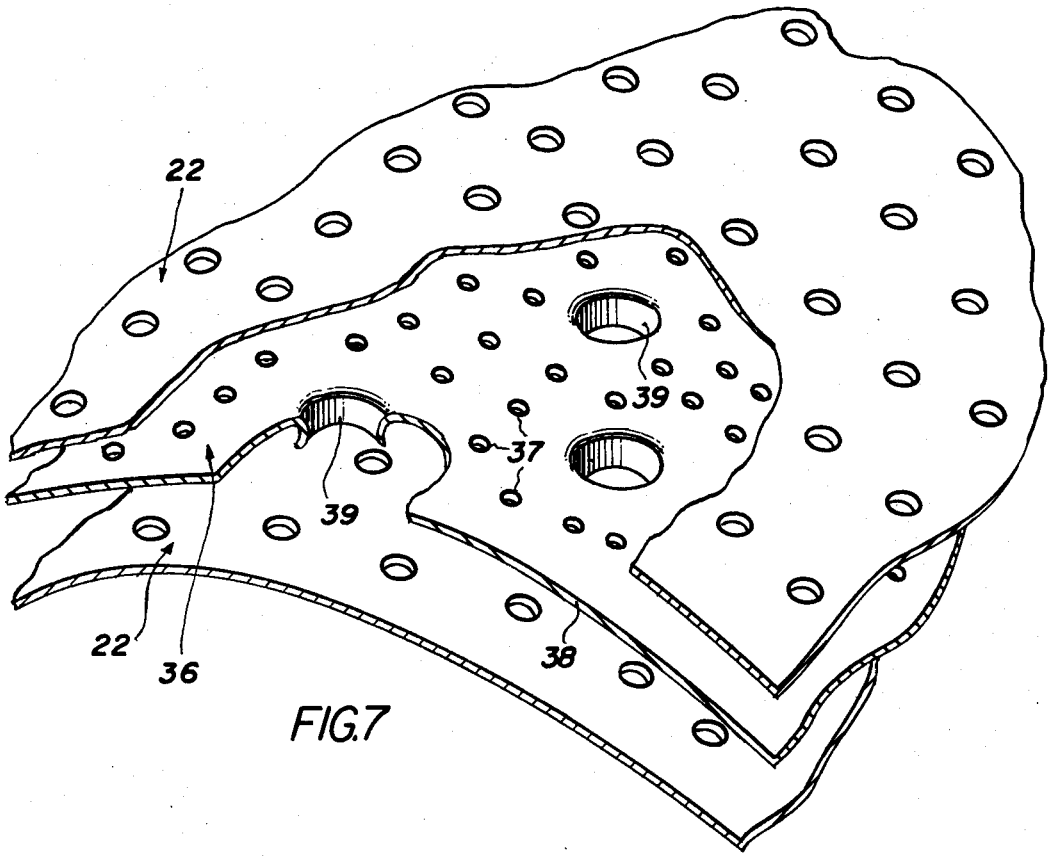
FIG. 7 is a similar view showing a distributing tray for the other phase.

What is considered to be novel in the present use is the method of distributing the flow of the liquids fed to the radially different portions of the chamber via the feed tubes 24 and 25. Provided to disperse the heavy liquid feed from tubes 24 is an annular open sided distributor tray 36, designated only by chain lines in FIG. 3, but more particularly illustrated in FIGS. 5, 7, and 9. The tray 36 is provided with cylindrical perforations 37 in its base 38 and open ended risers 39 of considerably larger diameter. At each end axially, tray 36 has a flange 40 which abuts the end wall 17 or 19 and the tray 36 extends from one end of the rotor chamber 21 to the other. In the case of the distributor tray 36, the riser openings 39 may be stated to face radially inwardly and FIG. 5 indicates the relationship between the slotted openings 34 and the risers 39, it being observed that the openings 34 permit the inflow of liquid slightly radially inwardly of the base 38, and radially outwardly of the open ends of the risers 39.

Figure 4:
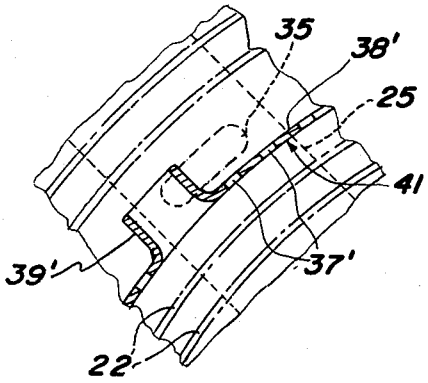
FIG. 4 is a greatly enlarged view of the area indicated to be in section 4 in FIG. 3.
Figure 6:
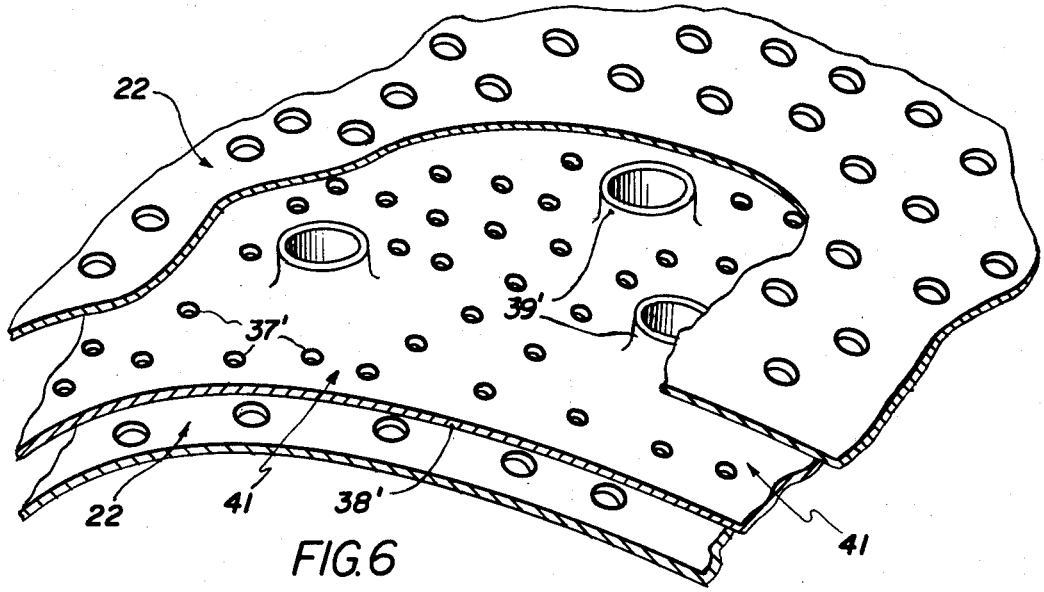
FIG. 6 is a considerably enlarged, fragmentary view of a distributor tray disposed between a pair of perforated plates.

The distributor tray 41 for servicing the light liquid feed tubes 25, which is likewise designated only by a chain line in FIG. 3, is identical in construction to the tray 36, except that its riser parts 39′ face radially outwardly as indicated in FIG. 4. As FIG. 6 indicates like parts have been designated by primed numbers in FIG. 6.

Figure 8:
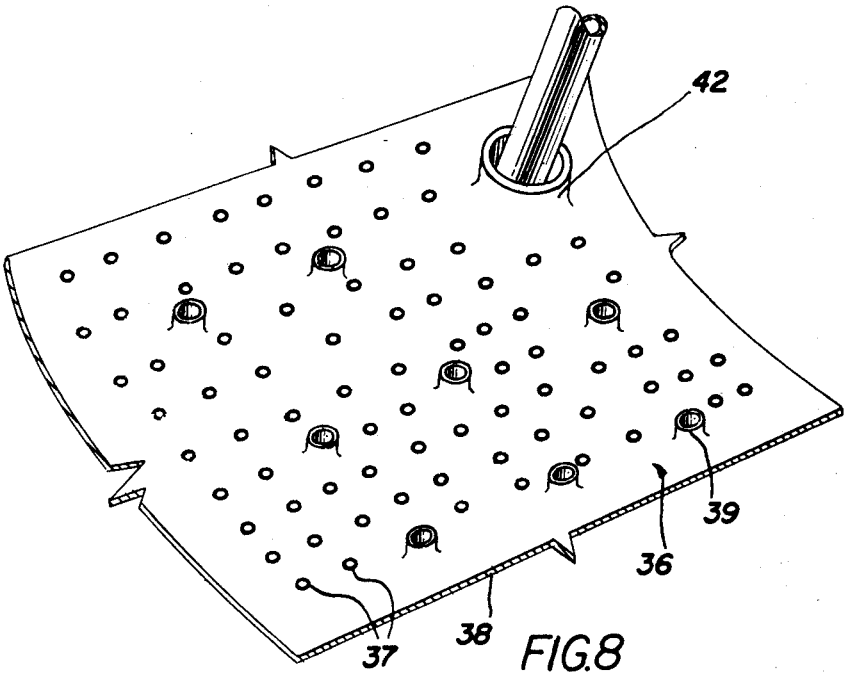
FIG. 8 is an enlarged fragmentary view of a portion of a distributor tray illustrating the manner in which the supply tubes extend up through enlarged risers in the tray.

FIG. 8 is a fragmentary view which demonstrates that in each of the plates 36 and 41, where necessary, enlarged risers 42 are provided to pass the tubes 24, 25, and 27. The risers 39, 39′, and 42 are of sufficient radial extent to permit a head to be developed to drive the phase through the distribution holes 37 or 37′ respectively, over the axial length of the trays 36 and 41 with a lineal velocity high enough to preclude counterflow of the other phase not being distributed.

Figure 9:
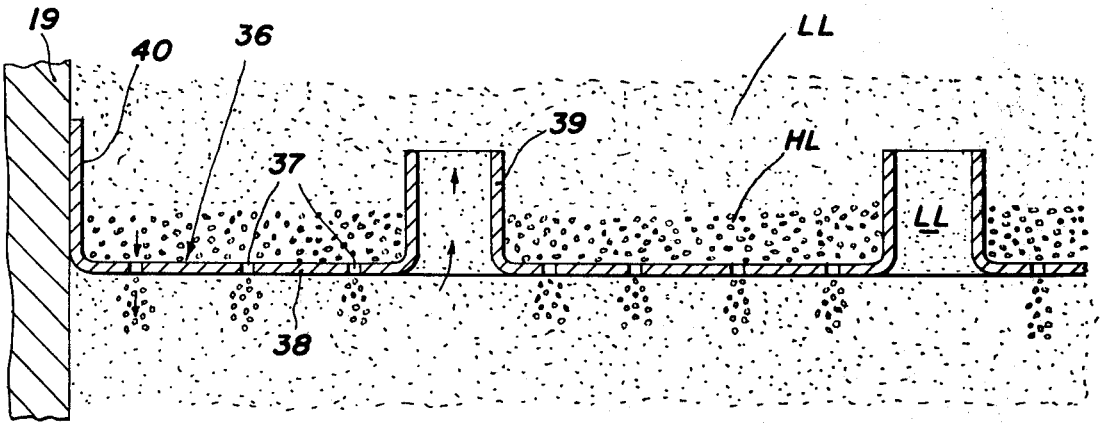
FIG. 9 is an enlarged fragmentary sectional view illustrating the manner in which the liquid head is utilized to drive the liquid being dispersed through the dispersing openings in a manner to avoid an inversion effect.

In the case of FIG. 9, the portion of tray 38 shown is situated below shaft 12. The head of heavy liquid, as determined by the metered flow rate supply passages 23, is high enough to preclude counterflow of the light phase liquid proceeding in the counterflow direction to the larger riser openings 39 and 42. The unobstructed area of riser openings 39, 39′ and 42 is the same. This differential head also provides the driving force for the flow of the continuous or light liquid phase through the risers 39′ and 42 in the opposite direction, and without counterflow of the heavy phase. Since the head decreases progressively axially outwardly from the openings 34, and 35 the head must be sufficient at the end walls 40 to provide for uniform axial distribution over the length of the trays 36 and 41 and the number of openings 37 and 37′ can be gradually increased uniformly in a direction toward end walls 40, or their cross-sectional area can be gradually increased progressively in the direction toward end walls 40. The same progressive variance in number of openings or size is accomplished with the light phase distributor tray 41 with respect to the end walls 40. As FIG. 3 indicates, both the trays 36 and 41 are located radially so as to be within the countercurrent contact zone. This means the interfaces between the two phases on trays 36 and 41 are radially outboard and inboard respectively of exit openings 30 and 27*a* respectively.

Since the light liquid enters at about twice the radial position of the heavy liquid, the head required for axial flow is about halved. The tray (41) area is about twice the tray (36) area and the degree of perforation of tray 41 is about one fifth that of tray 36 for the same gallons per minute inflow.

In terms of further parameters the smaller size openings for the phase to be dispersed should have a diameter typically around two to three millimeters and the open end risers should have a diameter typically in the range of eight to twenty-four millimeters. The height of the risers 39, 39′, and 42 should typically be limited to about one to two percent of the outer diameter of the centrifugal contactor chamber 21. The head of liquid required for uniform distribution of the phase to be dispersed over the axial length of the dispersing zone or zones must be less than the riser height provided.

The minimum number of holes (37 or 37′) for the dispersed phase in either of trays 36,41 may be calculated according to the following formula $$N = \frac{1.6Q}{WD^2}\sqrt{\frac{\rho}{\Delta\rho hR}},$$

where;

Q=the volumetric flow rate of the dispersed phase
W=the rotor speed in radians per second
D=diameter of holes for dispersed phase
h=height of risers
R=radial position of feed tray
$\rho$=density of the heavy phase
$\Delta\rho$=density difference between the phases It is preferable to provide a sufficient number of holes 37 or 37′ such that $$1 < \frac{\text{number of holes}}{\text{minimum number of holes}} < 2.$$

The minimum number of risers required for passage of the continuous phase may be calculated according to the formula $$N_n = 3\,N_d\left(\frac{Qc}{Qd}\right)\left(\frac{dd}{dc}\right)^2,$$

where;

$N_d$=the minimum number of holes 37 or 37′
$Q_c$=Volumetric flow rate of the continuous phase
$Q_d$=Volumetric flow rate of the dispersed phase
$d_d$=diameter of the holes 37 or 37′ for the dispersed phase
$d_c$=diameter of the riser passages Once the phase to be dispersed has been introduced onto the distribution tray, axial momentum effects tend to offset the axial head requirements required to cause the liquid to flow axially. For more extreme axial lengths, when a significant head gradiant is found to exist, uniform distribution can be achieved by providing an increasing number of holes per radial row which varies as the square root of the differential head. Alternately the actual spacing of rows can be decreased in proportion to the square root of the differential head.

In operation, and as FIGS. 1 and 2 particularly indicate, heavy liquid HL is supplied to the heavy liquid distribution tray 36 via openings 34, while simultaneously light liquid LL is supplied to the distribution tray 41 via tubes 25 and slotted openings 35. Heavy liquid HL collecting in the radially outer portion of the contactor adjacent wall 18 proceeds through openings 27*a* and discharge tubes 27 to the outlet tubes 29. The light liquid which collects adjacent the periphery of shaft 12 proceeds through the outlet openings 30 to the light liquid outlet 33. In the process, the heavy and light liquids are throughly contacted for whatever purpose the process contemplates.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

I claim:

1. In a centrifugal device for contacting at least partially immiscible liquid phases of heavy and light densities wherein there is included a rotor mounting a coaxial hollow casing having an outer cylindrical wall to provide a radially extending rotor chamber therein, the device further including a plurality of concentric radially relatively closely spaced annular partition walls surrounding the shaft which have perforations for the passage of the phases therethrough, and means for removing the heavier phase from the outermost portion of the rotor chamber and the lighter phase from the innermost portion of the rotor chamber, the device further including radially extending light phase inlet passageways extending to have communication with the radially outer portion of the rotor chamber and radially extending heavy phase inlet passageways having communication with the radially inner portion of the rotor chamber, and having means for continuously supplying light and heavy phase fluid to said respective inlet passageways;

the improvement comprising:

providing a pair of concentric radially spaced, annular, axially uniformly, phase distributing trays within the rotor chamber, radially spaced from the shaft and into which the inlet passageways empty, each tray consisting of an annular base wall and radially projecting walls extending therefrom radially oppositely from the other tray in the form of open-end risers surrounding riser passages through the base wall for flow of the other phase not being dispersed via the tray, the trays, further, in the base wall having much smaller openings relative to said riser passages and perforations in the said partition walls, which in number, in cross-sectional size, and in location are such, considering their distance axially from the particular inlet passageway feeding the tray, that the phase to be dispersed, from one end of the tray to the other, flows through them under pressure of the tray head developed without countercurrent flow of the other phase through them, the riser walls being of at least such radial extent as to collect a sufficient head of the phase to be dispersed via the tray to permit this, considering the inflow rate, the radial positions of the trays, the relative specific gravities of the phases, and the speed of rotation of the rotor chamber; and the riser passages being of such size as to achieve flow of the said other phase through the risers in the continuous phase.

2. The improved device of claim 1 wherein the radially outer tray area is in the neighborhood of twice the tray area for the radially inner tray.

3. The improved device of claim 2 wherein the overall perforate cross sectional area of said smaller openings in the radially outer tray base is in the neighborhood of about one fifth that of the radially inner tray.

4. In a centrifugal device for contacting phases of heavy and light densities wherein there is included a rotor mounting a coaxial hollow casing having an outer cylindrical wall to provide a radially extending rotor chamber therein, the device further including a plurality of concentric radially relatively closely spaced annular partition walls surrounding the shaft which have perforations for the passage of the phases therethrough, and means for removing the heavier phase from the outermost portion of the rotor chamber and the lighter phase from the innermost portion of the rotor chamber, the device further including radially extending light phase inlet passageways extending to have communication with the radially outer portion of the rotor chamber and radially extending heavy phase inlet passageways having communication with the radially inner portion of the rotor chamber, and having means for continuously supplying light and heavy phase fluid to said respective inlet passageways;

the improvement comprising:

providing a concentric radially spaced, annular, axially uniformly, phase distributing tray system within the rotor chamber, radially spaced from the shaft and into which an inlet passageway empties, the tray system consisting of an annular base wall and radially projecting walls extending therefrom in the form of open-end risers surrounding riser passages through the base wall for flow of the other phase not being dispersed via the tray system, the said base wall having much smaller openings relative to said riser passages and perforations in the said partition walls, which in number, in cross-sectional size, and in location are such, considering their distance axially from the inlet passageway feeding the tray system, that the phase to be dispersed, from one end of the tray system to the other, flows through them under pressure of the tray head developed without countercurrent flow of the other phase through them, the riser walls being of at least such radial extent as to collect a sufficient head of the phase to be dispersed via the tray system to permit this, considering the inflow rate, the radial position of the tray system the relative specific gravities of the phases, and the speed of rotation of the rotor chamber; and the riser passages being of such size as to achieve flow of the said other phase through the risers in the continuous phase.

5. The improved device of claim 4 in which a riser passage is enlarged sufficiently to pass said phase inlet passageway and still leave sufficient open cross-sectional area to approximate the cross-sectional area of the other riser passages.

6. The improved device of claim 4 in which the said smaller openings are about 2 to 3 millimeters in diameter and the riser passages are about 8 to 24 millimeters in diameter.

7. The improved device of claim 4 wherein the height of the risers is about one to two percent of the diameter of the rotor chamber.

8. The improved device of claim 4 wherein at least a minimum number of said smaller openings are provided according to the formula $$N = \frac{1.6Q}{WD^2}\sqrt{\frac{\rho}{\Delta\rho hR}}$$

where;

Q=the volumetric flow rate of the dispersed phase
W=the rotor speed in radians per second
D=diameter of holes for dispersed phase
R=radial position of feed tray
$\rho$=density of the heavy phase
$\Delta\rho$=density difference between the phases
h=height of risers.

9. The improved device of claim 4 wherein at least a minimum number of said risers with passages are provided according to the formula;

$$N = 3\,Nd\left(\frac{Qc}{Qd}\right)\left(\frac{dd}{dc}\right)^2$$

where;

$N_d$=the minimum number of holes 37 or 37'
$Q_c$=volumetric flow rate of the continuous phase
$Q_d$=volumetric flow rate of the dispersed phase
$d_d$=diameter of the holes 37 or 37' for the dispersed phase
$d_c$=diameter of the riser passages.

10. The improved device of claim 4 wherein the tray system is barrier free with the exception of said risers and inlet and outlet passageways.

11. The device of claim 4 wherein said perforations in the partition walls are of a size to pass both phases simultaneously.

12. A method of contacting phases of heavy and light densities comprising the steps of:

providing a rotor mounting a coaxial hollow casing having an outer cylindrical wall forming a radially extending rotor chamber therein which will subject phases contained therein to centrifugal force with rotation about the rotor axis;

providing concentric radially spaced sieves within the chamber with openings in such sieves;

providing first phase distributing means in the outer periphery of said chamber and containing therein the light density phase;

providing second phase distributing means in the inner periphery of said chamber and containing therein the heavy density phase;

providing phase inlet passageways to said first and second phase distributing means;

providing both the distributing means with openings, and at least one of them in tray form having a peripherally disposed base with dispersing openings therethrough interspersed with much larger area riser openings therethrough surrounded by radially projecting walls forming open-end risers, the dispersing openings in said base being smaller in area than the sieve openings and in number, in cross-sectional size, and in location being such, considering their distance axially from the inlet passageway feeding the said one distributing means, that the phase to be dispersed from one end axially of the base to the other flows through them under pressure of the head developed without counter-current flow of the other phase through them, the riser walls being of such radial extent, considering inflow rate, radial position in the rotor chamber, the relative specific gravities of the phases, and the speed of rotation of the rotor chamber as to collect a sufficient head to pass the phase being dispersed through the dispersing openings to permit this, without countercurrent flow of the other phase through them, while simultaneously under pressure of the differential head developed passing the said other phase through in the continuous phase;

ejecting the phases through the openings in both distributing means into the rotor chamber while rotating the rotor, the said phase being dispersed by said one distributing means being distributed into the rotor chamber through said dispersing openings without counterflow of the other phase through them, and the other phase moving through the riser openings in the continuous phase;

and thereafter passing both phases through the same sieve openings and contacting the one ejected phase directly with the other ejected phase as they move in counterflow.

13. The method of claim 12 wherein the phase being dispersed by said one distributing means passes through a minimum number of said smaller dispersing openings in said base, provided according to the formula $$N = \frac{1.6Q}{WD^2}\sqrt{\frac{\rho}{\Delta\rho hR}}$$

where:

Q=the volumetric flow rate of the dispersed phase
W=the rotor speed in radians per second
D=diameter of holes for dispersed phase
R=radial position of feed tray
$\rho$=density of the heavy phase
$\Delta\rho$=density difference between the phases
h=height of risers.

14. The method of either of claims 12 or 13 wherein the said phase passing in the said continuous phase passes through at least a minimum number of said risers provided in said base according to the formula:

$$N = 3\,Nd\left(\frac{Qc}{Qd}\right)\left(\frac{dd}{dc}\right)^2$$

where:

$N_d$=the minimum number of holes 37 or 37'
$Q_c$=volumetric flow rate of the continuous phase
$Q_d$=volumetric flow rate of the dispersed phase
$d_d$=diameter of the holes 37 or 37' for the dispersed phase
$d_c$=diameter of the riser passages.

15. The method of claim 12 in which the said dispersing openings are about 2 to 3 millimeters in diameter and the riser openings are about 8 to 24 millimeters in diameter.

16. The method of claim 12 wherein the height of the risers is about one to two percent of the diameter of the rotor chamber.

* * * * *